US005168812A

United States Patent [19]

Sugiyama

[11] Patent Number: 5,168,812

[45] Date of Patent: Dec. 8, 1992

[54] INK CLEANING APPARATUS FOR ROTARY PRINTING PRESS

[75] Inventor: Hiroyuki Sugiyama, Ibaraki, Japan

[73] Assignee: Komori Corporation, Japan

[21] Appl. No.: 883,596

[22] Filed: May 14, 1992

[30] Foreign Application Priority Data

May 24, 1991 [JP] Japan ..... 3-46495[U]

[51] Int. Cl.[5] ..... B41F 35/00; B41L 41/04

[52] U.S. Cl. ..... 101/425; 101/423; 15/256.51

[58] Field of Search ..... 101/424, 423, 425; 15/256.5, 256.51, 256.52

[56] References Cited

U.S. PATENT DOCUMENTS

| | | | |
|---|---|---|---|
| 1,287,524 | 12/1918 | Trier | 101/424 |
| 4,110,035 | 8/1978 | Kamata | 15/256.52 |
| 4,140,388 | 2/1979 | Ikesue | 15/256.51 |
| 4,650,311 | 3/1987 | Mayer | 15/256.51 |
| 4,991,507 | 2/1991 | Nozaka et al. | 101/423 |
| 5,046,416 | 9/1991 | Freyer et al. | 101/425 |

*Primary Examiner*—David A. Wiecking
*Assistant Examiner*—Anthony H. Nguyen
*Attorney, Agent, or Firm*—Blakely, Sokoloff, Taylor & Zafman

[57] ABSTRACT

An ink cleaning apparatus for a rotary printing press includes a blade shaft, a rewind roller, a take-up roller, a hygroscopic band member, and a doctor blade. The blade shaft is pivotally supported to be parallel to an ink roller near the ink roller. The rewind roller and the take-up roller are respectively supported in parallel to the blade shaft. The hygroscopic band member is rewound from the rewind roller and taken up by the take-up roller after being brought into contact with the blade shaft. The doctor blade is fixed on the blade shaft. The distal end portion of the doctor blade is brought into contact with an outer surface of the ink roller upon pivotal movement of the blade shaft in one direction. The flat surface of the doctor blade which is attached with a waste liquid is brought into tight contact with the band member upon pivotal movement of the blade shaft on the other direction.

6 Claims, 1 Drawing Sheet

INK CLEANING APPARATUS FOR ROTARY PRINTING PRESS

BACKGROUND OF THE INVENTION

The present invention relates to an ink cleaning apparatus, arranged in an inking arrangement, for cleaning an ink from an ink roller at the time of a color change or at the end of a printing operation.

A rotary printing press comprises an inking arrangement for supplying an ink to a machine plate mounted on the outer circumferential surface of a plate cylinder and a dampening arrangement for supplying dampening water. An image formed by the ink and the dampening water supplied from the inking and dampening arrangements and formed on the machine plate is transferred to paper directly or through a blanket cylinder, thereby printing the image. The inking arrangement comprises an ink fountain roller rotated in an ink fountain which stores an ink, a form roller detachably arranged in rolling contact with the machine plate, and vibrating and ink distributing rollers and the like arranged between the ink fountain roller and the form roller. An ink supplied from the ink fountain upon rotation of the ink fountain roller is uniformly distributed in all directions during ink transfer between a large number of ink rollers and is then supplied to the surface of the machine plate by the form roller.

An ink cleaning apparatus for cleaning an ink from the ink roller at the time of a color change or at the end of a printing operation is added to this inking arrangement. A conventional ink cleaning apparatus is arranged as follows. An elongated bucket-like waste liquid container is supported between right and left frames. For example, in this waste liquid container, the sharp distal end of a doctor blade is detachably supported in contact with the outer surface of a vibrating roller as one of a large number of ink rollers. With this arrangement, all the ink rollers are rotated, the distal end portion of the doctor blade is brought into contact with the outer surface of the vibrating roller, and a cleaning solution is dropped downward to the ink rollers manually or by a cleaning solution supply unit. The cleaning solution is then transferred and circulated between the ink rollers to remove the ink. A waste liquid as a mixture of the cleaning solution and the ink is scraped by the doctor blade and is stored in the waste liquid container. Upon cleaning, the doctor blade is separated from the outer surface of the vibrating roller, and the waste liquid attached to the doctor blade is removed. The waste liquid stored in the waste liquid container is treated upon completion of a cleaning operation or periodically during printing.

In this ink cleaning apparatus, however, since the waste liquid scraped by the doctor blade is stored in the waste liquid container, the waste liquid in the waste liquid container must be discharged, or the interior of the waste liquid container must be cleaned so as to prevent the waste liquid from solidification. In addition, the waste liquid attached to the doctor blade and the waste liquid in the waste liquid container are to be discharged, a spilt ink must be manually scraped before it is solidified, thus requiring much labor and a time-consuming operation. As a result, energy savings cannot be achieved, and high operating efficiency of the printing press cannot be obtained.

SUMMARY OF THE INVENTION

It is an object of the present invention to provide an ink cleaning apparatus for a rotary printing press, capable of easily treating a waste liquid within a short period of time.

It is another object of the present invention to provide an ink cleaning apparatus for a rotary printing press, capable of shortening a printing preparation time to improve operating efficiency of the printing press.

It is still another object of the present invention to provide an ink cleaning apparatus for a rotary printing press, capable of preventing a waste liquid from being spilt and hence preventing contamination of working environments.

In order to achieve the above objects of the present invention, there is provided an ink cleaning apparatus for a rotary printing press, comprising a blade shaft pivotally supported to be parallel to an ink roller near the ink roller, a rewind roller and a take-up roller which are respectively supported in parallel to the blade shaft, a hygroscopic band member rewound from the rewind roller and taken up by the take-up roller after being brought into contact with the blade shaft, and a doctor blade which is fixed on the blade shaft, a distal end portion of which is brought into contact with an outer surface of the ink roller upon pivotal movement of the blade shaft in one direction, and a flat surface of which is brought into tight contact with the band member upon pivotal movement of the blade shaft on the other direction, the flat surface being attached with a waste liquid.

DESCRIPTION OF THE PREFERRED EMBODIMENT

Figure 1:
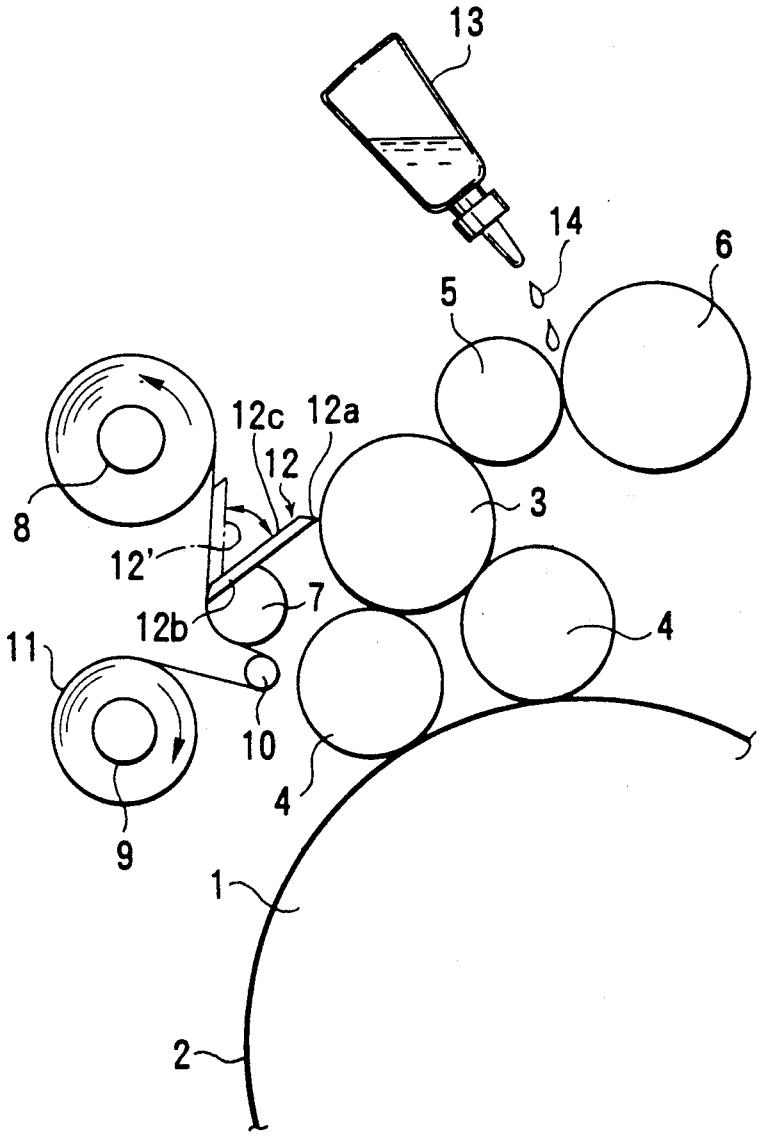
FIG. 1 is a schematic front view showing the main part of an ink cleaning apparatus for a rotary printing press according to an embodiment of the present invention.

FIG. 1 shows an ink cleaning apparatus for a rotary printing press according to an embodiment of the present invention. Referring to FIG. 1, a machine plate 2 is mounted on the outer circumferential surface of a plate cylinder 1 supported to be rotated between right and left frames. A plurality of form rollers 4 supported through a roller arm on a vibrating roller 3 serving as an ink roller are detachably arranged in contact with the surface of the machine plate 2. Another vibrating roller 6 is in contact with an ink distributing roller 5 in contact with the vibrating roller 3. A large number of ink rollers (not shown) in addition to the illustrated ink rollers are in contact with each other in the inking arrangement.

Both end portions of a blade shaft 7 parallel to the vibrating roller 3 are pivotally supported by the right and left frames near the vibrating roller 3. Both ends of a take-up roller 8 and a rewind roller 9 which are parallel to the blade shaft 7 are pivotally supported by the right and left frames at obliquely upper and lower positions of the blade shaft 7. Reference numeral 10 denotes a guide roller located below the blade shaft 7 and pivotally supported between the right and left frames. Cloth 11 as a band member is wound around the rewind roller 9. This cloth 11 is rewound and brought into contact with the guide roller 10 and the blade shaft 7 and is then taken up by the take-up roller 8. The outer surface of the blade shaft 7 is axially notched, and a proximal end portion 12*b* of an elongated doctor blade 12 is screwed on the notched portion of the blade shaft 7. When the blade shaft 7 is pivoted clockwise (FIG. 1), a distal end portion 12*a* of the doctor blade 12 is brought into contact with the outer surface of the vibrating roller 3 throughout the length thereof, as indicated by a solid line in FIG. 1, so that a flat surface 12*c* of the doctor blade 12 is in tight contact with the cloth 11 traveling upon take-up operation, as indicated by an alternate long and short dashed line 12' in FIG. 1. The width of the cloth 11 is equal to or larger than the length of the doctor blade 12. Reference numeral 13 denotes a container which stores a cleaning solution 14. In this embodiment, the cleaning solution 14 is manually dropped from the container 13 to a portion between, e.g., the ink distributing roller 5 and the vibrating roller 6.

The operation of the ink cleaning apparatus having the above arrangement will be described below. All the ink rollers are rotated, and the blade shaft 7 is pivoted clockwise to bring the entire distal end portion of the doctor blade 12 into contact with the outer surface of the vibrating roller 3. When the cleaning solution 14 is then axially dropped in an average amount on a portion between, e.g., the ink distributing roller 5 and the vibrating roller 6, the cleaning solution 14 is transferred and circulated between all the ink rollers to clean the rollers. A waste liquid as a mixture of the ink and the cleaning solution 14 is scraped by the doctor blade 12 from the outer surface of the vibrating roller 3 when the waste liquid passes through the vibrating roller 3. Upon rotation of the take-up roller 8, the cloth 11 rewound from the rewind roller 9 is brought into slidable contact with the guide roller 10 and the blade shaft 7 and is taken up by the take-up roller 8. The waste liquid scraped by the doctor blade 12 flows from the distal end portion 12*a* to the proximal end portion 12*b* through the flat surface 12*c* of the doctor blade 12 and is attached to the blade shaft 7. The waste liquid attached to the blade shaft 7 is absorbed by the cloth 11. After cleaning, when the blade shaft 7 is rotated counterclockwise (FIG. 1), the doctor blade 12 is pivoted and the entire flat surface 12*c* is brought into tight contact with the cloth 11 which keeps traveling, as indicated by the alternate long and short dashed line 12' in FIG. 1. All the waste liquid attached to the doctor blade 12 is perfectly removed. When several cleaning operations are performed and the cloth 11 on the rewind roller 9 runs out, the cloth 11 taken up by the take-up roller 8 is discarded while being kept wound on the take-up roller 8. A new take-up roller 8 and a new rewind roller 9 on which new cloth 11 is wound are mounted in place of the old ones.

In this embodiment, the band member in which the waste liquid is absorbed is exemplified by the cloth 11. However, paper may be used in place of cloth. In this embodiment, the cleaning solution is supplied to the ink roller manually. However, the cleaning solution may be supplied by a mechanical supply unit. In addition, an ink roller with which the distal end of the doctor blade 12 is brought contact is not limited to the vibrating roller 3, but can be any ink roller.

As has been described above, according to the present invention, in the ink cleaning apparatus for a rotary printing press, the band member which is traveling in contact with the blade shaft to which the doctor blade is fixed is arranged, and the waste liquid scraped by the doctor blade and flowing along its flat surface is absorbed by the band member. After cleaning, the blade shaft is pivoted to bring the flat surface of the doctor blade into contact with the band member, thereby scraping the waste liquid attached to the flat surface of the doctor blade by the traveling band member. Unlike in the conventional case, the waste liquid container need not be cleaned, and the waste liquid attached to the doctor blade need not be manually scraped. A waste liquid treatment can be facilitated and can be performed within a short period of time. The labor of the operator can be reduced, and energy savings can be achieved. The printing preparation time can be shorted, and operating efficiency of the printing press can be improved. Automatic ink cleaning can be facilitated, and the waste liquid will not be spilt, thereby preventing contamination of the working environments.

What is claimed is:

1. An ink cleaning apparatus for a rotary printing press, comprising:

an ink roller, a blade shaft pivotally supported parallel to said ink roller;

a rewind roller and a take-up roller which are supported parallel to said blade shaft;

a hygroscopic band member carried by and unwound from said rewind roller and taken up by said taken-up roller after being brought into contact with said blade shaft; and a doctor blade fixed on said blade shaft, said doctor blade having a distal end portion which is brought into contact with an outer surface of said ink roller upon pivotal movement of said blade shaft in one direction, and a flat surface which is brought into tight contact with said band member upon pivotal movement of said blade shaft in a direction opposite said one direction, waste liquid accumulating on said flat surface when said distal.

2. An apparatus according to claim 1, wherein said doctor blade comprises an elongated member having an overall length substantially equal to that of said ink roller, and said doctor blade has a proximal end portion fixed on an outer surface of said blade shaft.

3. An apparatus according to claim 1, wherein said band member has a width larger than at least the length of said doctor blade.

4. An apparatus according to claim 1, wherein said band member is made of cloth.

5. An apparatus according to claim 1, wherein said band member is made of paper.

6. An apparatus according to claim 1, wherein said ink roller is a vibrating roller located between a form roller and an ink distributing roller.

* * * * *